148-111 SR
10/22/85 OR 4,548,656

United States Patent [19]
Kimoto et al.

[11] Patent Number: 4,548,656
[45] Date of Patent: Oct. 22, 1985

[54] METHOD AND APPARATUS FOR REDUCING THE WATT LOSS OF A GRAIN-ORIENTED ELECTROMAGNETIC STEEL SHEET AND A GRAIN-ORIENTED ELECTROMAGNETIC STEEL SHEET HAVING A LOW WATT LOSS

[75] Inventors: Tetsuo Kimoto; Kiyoshi Orita; Katsuro Kuroki, all of Kitakyushu, Japan

[73] Assignee: Nippon Steel Corporation, Tokyo, Japan

[21] Appl. No.: 398,334

[22] Filed: Jul. 15, 1982

[30] Foreign Application Priority Data

Jul. 17, 1981 [JP] Japan ..... 56-110858

[51] Int. Cl.[4] ..... H01F 1/04
[52] U.S. Cl. ..... 148/111; 148/112
[58] Field of Search ..... 148/111, 112, 113

[56] References Cited

U.S. PATENT DOCUMENTS

| | | | |
|---|---|---|---|
| 3,647,575 | 3/1972 | Fiedler et al. | 148/111 |
| 3,947,296 | 3/1976 | Kumazawa et al. | 148/111 |
| 3,990,923 | 11/1976 | Takashima et al. | 148/111 |
| 4,293,350 | 10/1981 | Ichiyama et al. | 148/111 |
| 4,363,677 | 12/1982 | Ichiyama et al. | 148/111 |

*Primary Examiner*—John P. Sheehan
*Attorney, Agent, or Firm*—Kenyon & Kenyon

[57] ABSTRACT

The watt loss of a grain-oriented electromagnetic steel sheet can be decreased by known methods in which serrations or scratches are locally formed on said steel sheet or a small ball or disc is rolled or rotated over said steel sheet. The known methods are disadvantageous in that the rate of production is low and in that said steel sheet has a marked unevenness.

In the present invention, particles, e.g., steel shots, are projected onto substantially linear selected portions of a grain-oriented electromagnetic steel sheet, thereby producing strain on spot-formed regions. Spotlike indentations are formed in the steel sheet by the projection of steel shots onto the steel sheet.

3 Claims, 8 Drawing Figures

METHOD AND APPARATUS FOR REDUCING THE WATT LOSS OF A GRAIN-ORIENTED ELECTROMAGNETIC STEEL SHEET AND A GRAIN-ORIENTED ELECTROMAGNETIC STEEL SHEET HAVING A LOW WATT LOSS

The present invention relates to a method and apparatus for reducing the watt loss of a grain-oriented electromagnetic steel sheet and a grain-oriented electromagnetic steel sheet having a low watt loss.

Generally speaking, a grain-oriented electromagnetic steel sheet consists of crystal grains, the direction of easy magnetization, i.e. the [100] axis, of which is parallel to the rolling direction, and grain-orientation of a grain-oriented electromagnetic steel sheet occurs during final annealing, in which secondary recrystallization takes place. Grain-oriented electromagnetic steel sheets which are conventionally produced have either a single orientation, in which the (110) plane and [100] axis of the crystal grains are parallel to the sheet surface and the rolling direction, respectively, or a double orientation, in which the (100) plane and [001] axis of the crystal grains are parallel to the sheet surface and the rolling direction, respectively.

Attempts have been made to enhance the degree of orientation of a grain-oriented electromagnetic steel sheet so that the grain-orientation of all of the crystals of the sheet is virtually ideal, or (110) [001], in the case of a grain-oriented electromagnetic steel sheet having a single orientation, the reason being that, generally speaking, the exciting characteristic is increased and the watt loss is decreased when the degree of orientation is increased. As a result of these attempts, it is now possible to industrially produce a grain-oriented electromagnetic steel sheet which exhibits a magnetic flux density of 1.7 Tesla when the sheet thickness is 0.3 mm. In order to further reduce watt loss, a method different than the method for enhancing the degree of orientation of a grain-oriented electromagnetic steel sheet must be employed. In other words, it is difficult to further reduce watt loss only by enhancing the degree of orientation, for the reasons given below. The watt loss of a grain-oriented electromagnetic steel sheet is dependent on the exciting characteristic and the grain size. More specifically, the watt loss of a grain-oriented electromagnetic steel sheet can be reduced by enhancing the exciting characteristic and by decreasing the grain size. The exciting characteristic of a grain-oriented electromagnetic steel sheet is usually enhanced by increasing the grain size. The grain size of a grain-oriented electromagnetic steel sheet is conventionally increased by increasing the degree of orientation, but this increase simultaneously involves a factor which disadvantageously increases watt loss and a factor which advantageously decreases watt loss by increasing the exciting characteristic.

It is known to decrease the watt loss of a grain-oriented electromagnetic steel sheet by applying tension to the sheet surface. An industrial method for applying tension to the sheet surface involves the application of an insulating film to the steel sheet. The reduction in watt loss due to the application of an insulating film is, however, limited because the tension applied to the sheet surface by the insulating film is limited. The lowest watt loss attained by means of the industrial tension-applying method mentioned above is approximately 1.03 watts/kg at a frequency of 50 Hz.

It is also known to decrease the watt loss of a grain-oriented electromagnetic steel sheet by means of mirror finishing, such as chemical polishing or electrolytic polishing, occasionally followed by the application of insulating film to the steel sheet. This method for decreasing watt loss is, however, disadvantageous in the respect that watt loss greatly varies depending upon the smoothness of the polished steel sheet. The watt loss of a grain-oriented electromagnetic steel sheet having an insulating film thereon, therefore, also greatly varies because the properties of the insulating film are changed due to the smoothness of the polished steel sheet.

It is proposed in Japanese Published Patent Application No. 50-35679 (1975) that the surface of a grain-oriented electromagnetic steel sheet be serrated or scratched with a knife or an abrasive material so as to reduce watt loss. Serration or scratching unavoidably results in the formation of flaws on a grain-oriented electromagnetic steel sheet and, thus, in an unevenness around the flaws. Consequently, not only is the space factor of the laminated sections of a grain-oriented electromagnetic steel sheet drastically decreased due to the unevenness mentioned above but also the magnetostriction of the steel sheet is drastically increased due to serration or scratching. In addition, burrs, which are formed at both ends of the scratches during scratching, protrude from the sheet surface, and when sections of a grain-oriented electromagnetic steel sheet are laminated, the burrs on said sections protrude through the insulating film applied to the adjacent section. Proposals have been made for eliminating the disadvantages due to serration or scratching and for reducing watt loss to below that attained by enhancing the degree of orientation.

One of the proposals disclosed in Japanese Laid-open Patent Application No. 53-137016 (1978) is that a minute strain be produced in a grain-oriented electromagnetic steel sheet by rolling or rotating a small ball or disc over the steel sheet at a constant pressure. Another proposal disclosed in Japanese Laid-open Patent Application No. 54-43115 (1979) is that a minute strain be produced in a mirror-finished grain-oriented electromagnetic steel sheet by rolling or rotating a small ball or disc over the mirror-finished steel sheet. These proposals do, in fact, eliminate the disadvantages due to serration or scratching and reduce watt loss further. However, they still involve problems to be solved from a commercial point of view. One of the problems is that since a small ball or disc is rolled or rotated over a grain-oriented electromagnetic steel sheet so as to produce a minute strain, the steel sheet must either be made stationary or must be conveyed during the production of a minute strain. Another problem is that it is difficult to enhance the production of steel sheets since the relative rolling or rotating speed of a small ball or disc over the grain-oriented electromagnetic steel sheet is limited.

It is an object of the present invention to provide a method by which the watt loss of a grain-oriented electromagnetic steel sheet is reduced by producing a minute strain in the steel sheet, by which flaws which decrease the space factor of the laminated sections of the steel sheet do not occur, and by which the production of steel sheets is enhanced.

It is another object of the present invention to provide an apparatus for carrying out the method mentioned above.

It is still another object of the present invention to provide a grain-oriented electromagnetic steel sheet which has a low watt loss due to strain produced therein and such a good surface property that the space factor of the laminated sections is high.

A method for reducing the watt loss of a grain-oriented electromagnetic steel sheet according to the present invention is characterized in that after final annealing of a steel sheet during which grain-orientation occurs, particles are projected onto substantially linear selected portions of the grain-oriented electromagnetic steel sheet, thereby producing a strain in the spot-formed regions of said selected portions of the grain-oriented electromagnetic steel sheet.

An apparatus for reducing the watt loss of a grain-oriented electromagnetic steel sheet according to the present invention comprises:

a stationary plate including at least one slit;

a slidable plate capable of reciprocating which is in contact with said stationary plate and includes a slit capable of registering with said at least one slit of said stationary plate; and at least one means for projecting particles oriented toward said stationary plate.

Another apparatus for reducing the watt loss of a grain-oriented electromagnetic steel sheet according to the present invention comprises:

a rotatable drum;

a rotatable drum having at least one slit on the cylindrical wall thereof; and at least one means for projecting particles, said means being located inside or outside said rotatable drum.

A grain-oriented electromagnetic steel sheet having a low watt loss according to the present invention is characterized in that substantially linear selected portions of said grain-oriented electromagnetic steel sheet have spotlike indentations, which are formed due to the projection of particles, and in that strain is produced due to said spotlike indentations.

A grain-oriented electromagnetic steel sheet having a low watt loss according to the present invention is also characterized in that substantially linear selected portions of an insulating film, which is applied to said grain-oriented electromagnetic steel sheet, have spotlike identations which are formed due to the projection of particles and in that strain is produced in said grain-oriented electromagnetic steel sheet due to said spotlike indentations. The word "grain-oriented electromagnetic steel sheet" herein includes a grain-oriented electromagnetic steel strip.

Embodiments of the present invention are hereinafter explained with reference to the drawings, wherein.

Figure 2:
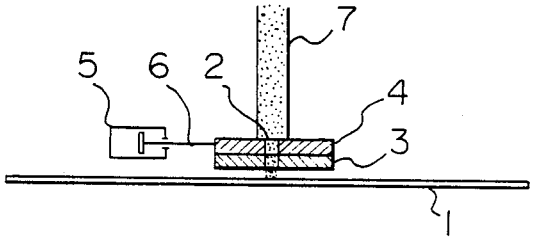
FIG. 2 illustrates how steel shots are projected onto one substantially linear selected portion of a grain-oriented electromagnetic steel sheet in accordance with the method of the present invention.
Figure 3:
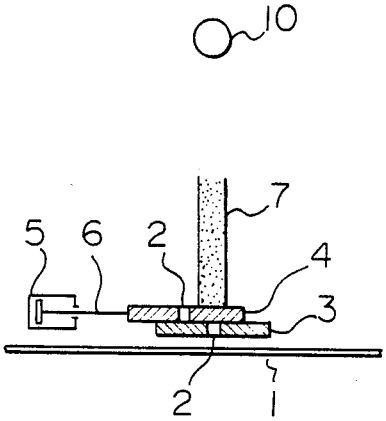
Figure 4:
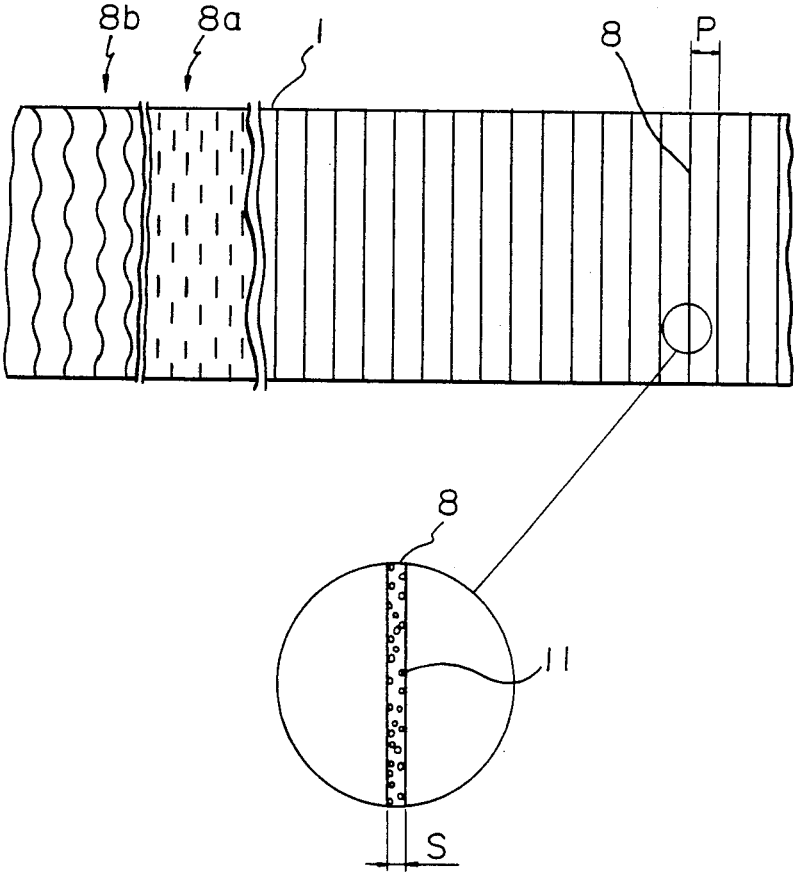
Figure 5:
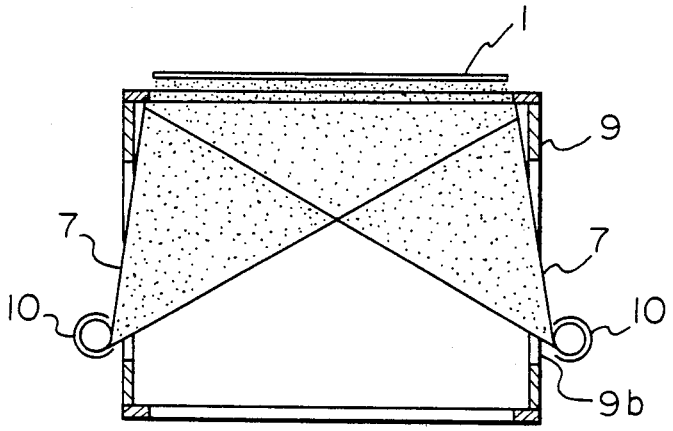
Figure 6:
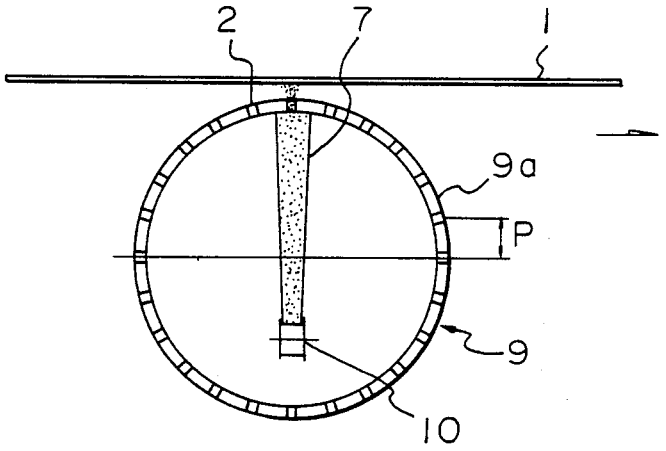
Figure 7:
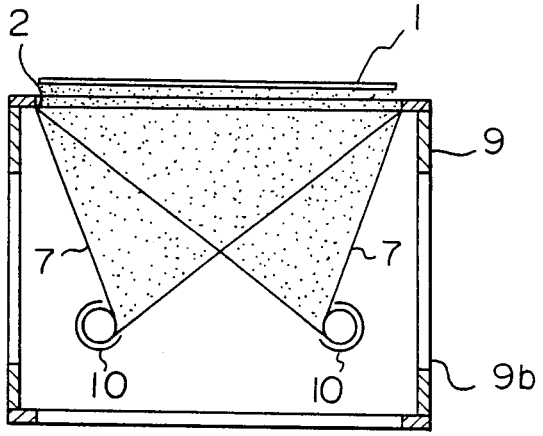
Figure 8:
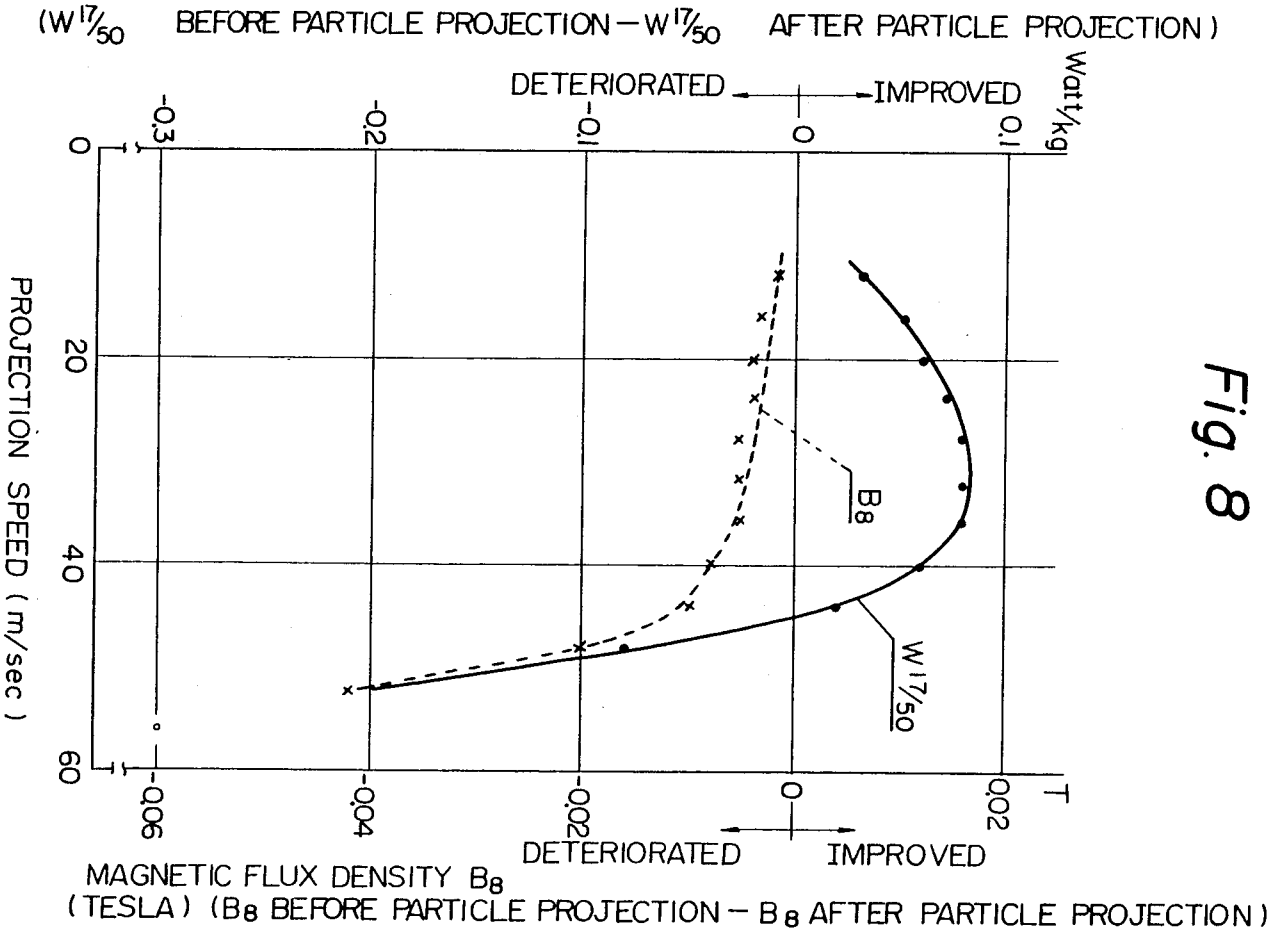

FIG. 3, which is similar to FIG. 2, illustrates how projection of the steel shots is interrupted;

FIG. 4 shows embodiments of the substantially linear selected portions of a grain-oriented electromagnetic steel sheet in which strain is produced due to the projection of particles;

FIG. 5 is a view of an embodiment of an apparatus according to the present invention;

FIG. 6 is a cross-sectional view of the apparatus shown in FIG. 5;

FIG. 7 is a view of another embodiment of an apparatus according to the present invention; and FIG. 8 is a graph showing the magnetic flux densit ($B_8$) and the watt loss ($W_{17/50}$) obtained as a result of the projection of particles.

Figure 1:
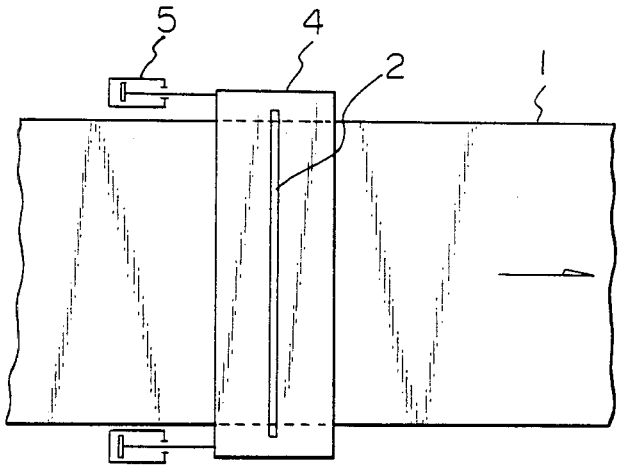
FIG. 1 is a plan view of an embodiment of an apparatus according to the present invention.

In FIGS. 1 through 3, a grain-oriented electromagnetic steel sheet is denoted by reference numeral 1 and is hereinafter simply referred to as steel sheet 1. Steel sheet 1 contains 4.0% or less of silicon and, as stated hereinabove, has been subjected to final annealing, during which grain orientation occurs.

Therefore, when steel sheet 1 is subjected to the projection of particles, steel sheet 1 may or may not be provided with an insulating film (not shown) thereon. The insulating film (not shown) may be a secondary insulating film composed of a phosphate or an organic compound and may have a thickness of from 1 to 5 microns. In addition, the projection of particles may be carried out after a heat-flattening step.

Steel sheet 1 is transferred in the direction indicated by the arrow (FIG. 1) and along a pass line. Stationary plate 3 is disposed above steel sheet 1 so as to maintain a predetermined distance between stationary plate 3 and steel sheet 1. Slidable plate 4 is located on stationary plate 3 and is connected to drive means 5, e.g., a hydraulic or pneumatic cylinder, via piston rod 6. Slidable plate 4 is therefore caused to reciprocate by drive means 5 when slidable plate 4 is in contact with stationary plate 3. Stationary plate 3 and slidable plate 4 are each provided with slit 2, the length of slit 2 being slightly greater than the width of steel sheet 1. Only when both slits 2 register due to the reciprocation of slidable plate 4 is particle-projecting means 10 (FIG. 3), which is oriented toward slit 2 of slidable plate 4, actuated so as to project particles, for example, steel shots 7, onto the substantially linear selected portions (hereinafter simply referred to as the selected portions) of steel sheet 1 (FIG. 2). Since a number of steel shots 7 impinge upon the selected portions, a number of minute spotlike identations are formed and strain is generated in minute spot-formed regions. Also, since the impinging pattern is determined by the linear shape of slits 2 extending in the short width direction of steel sheet 1, the minute spot-formed regions have a linear configuration.

As the projected particles, not only steel shots but also other metal shots, organic resin particles, ceramic particles, and plant material particles can be used. The particles should have an essentially spherical shape. Projection of the particles can be carried out together with the injection of a fluid, such as a gas, e.g. air, or a gas-liquid mixture by means of at least one nozzle.

Steel shots are conventionally used to descale rolled steel products. The impinging force of the steel shots according to the method of the present invention may not be as great as in the case of descaling, but an impinging force great enough to lightly strike the surface of steel sheet 1 is sufficient to reduce watt loss. The impinging force can be optionally adjusted depending upon the projection rate, the size, the material, and the hardness of the particles and upon the width of slits 2, as well as upon the tension which may be applied to steel sheet 1 being transferred. As in every method for producing strain in a grain-oriented electromagnetic steel sheet, a very large strain does not reduce watt loss but instead increases watt loss.

In FIG. 4, a number of selected portions 8 of steel sheet 1 are linear, are substantially perpendicular to the rolling direction of steel sheet 1, and are parallel to one another. Each of selected portions 8 is a continuous line or curve. Also, each of selected portions 8 may be a discontinuous line 8a or curve 8b. The width (S) of selected portions 8 is preferably from 0.1 to 0.3 mm. The spotlike indentations are indicated in FIG. 4 by reference numeral 11. The surface area of spotlike indentations 11 is considerably smaller than that of selected portions 8. Spotlike indentations 11 have a diameter of from approximately 60 to 80 microns and a depth of from approximately 3 to 5 microns. It is important that the dimension of spotlike indentations 11 be small and narrow so as to reduce the watt loss of steel sheet 1. Steel sheet 1 has no burrs around spotlike indentations 11 because indentations 11 are formed by the projection of steel shots (FIGS. 2 and 3). The regions of steel sheet 1 where strain is produced are substantially linear. Strictly speaking, such regions are defined by a number of small spot-formed regions which are substantially linearly arranged. Although selected portions 8 are linear and are substantially perpendicular to the rolling direction, the selected portions of a grain-oriented electromagnetic steel sheet having any other pattern may be subjected to the projection of particles. For example, discontinuous or continuous portions, which extend linearly or non-linearly in the rolling direction, may be subjected to the projection of particles.

When steel sheet 1 has an insulating film (not shown) applied thereon prior to the projection of particles, spotlike indentations 11 do not seriously damage the insulating film. In addition, a marked reduction in watt loss is attained, for example, approximately 0.08 watts/kg in terms of $W_{17/50}$, while at the same time the space factor of the laminated sections of steel sheet 1 is not markedly reduced due to spotlike indentations 11.

The distance between selected portions 8, hereinafter referred to as the linear-strain pitch (p), is optionally selected in the range of from 3 to 10 mm. The linear-strain pitch (p) can be adjusted by adjusting the reciprocating speed of slidable plate 4.

Although one slit 2 is provided for stationary plate 3 and slidable plate 4 in the apparatus shown in FIGS. 1 through 3, a plurality of slits may be provided for stationary plate 3 and slidable plate 4. In order to decrease the linear-strain pitch (p), the transferring speed of steel sheet 1 must be increased, the reciprocating speed of slidable plate 4 must be increased, or the number of slits 2 must be increased. Increasing the number of slits 2 is more advantageous for decreasing the linear-strain pitch (p) than is increasing the reciprocating speed since the reciprocating speed is limited due to the construction of slidable plate 4 and drive means 5.

In FIGS. 5 and 6, an apparatus according to the present invention comprises rotatable drum 9, which can be rotated at a circumferential speed which is synchronous with the transferring speed of steel sheet 1. Slits 2 are formed on cylindrical wall 9a of rotatable drum 9, and the distance between slits 2 corresponds to the linear-strain pitch (p). There are two means for projecting particles, i.e. two impellers 10, one of impellers 10 being located beside one side end of rotatable drum 9 and the other impeller 10 being located beside the other side end of rotatable drum 9. Two impellers 10 project steel shots 7 through apertures 9b of the two side ends of rotatable drum 9 and slits 2 of rotatable drum 9 onto selected portions (not shown in FIG. 6). The device shown in FIGS. 5 and 6 can be used for treating a steel sheet which is transferred at a high line speed, for example, 100 meters/min or from 200 to less than 1,000 meters/min.

In FIG. 7, impellers 10 are located within rotatable drum 9. Although two impellers 10 are shown, there may be only one or more than two provided that the particle projecting means is oriented toward the slits of the rotatable drum.

The apparatuses according to the present invention are practical, simple, and inexpensive from the point of view of installation costs. Since steel shots 7 are recovered by a recovering device (not shown), the operation costs of the method according to the present invention are very low.

The present invention is further explained by way of an example.

EXAMPLE

The projection of particles was carried out by means of rotatable drum 9 and impellers 10 shown in FIGS. 5 and 6.

Steel sheet 1 was a commercially available conventional grain-oriented steel sheet and had a thickness of 0.30 mm.

Steel sheet 1 had the following magnetic properties before the projection of particles:

$W_{17/50}$: 1.00~1.10 watts/kg.

$B_8$: 1.93~1.96 Tesla.

$W_{17/50}$ is the watt loss at a magnetic flux density of 1.7 Tesla and at a frequency of 50 Hz.

The conditions under which particles were projected were as follows:

Kind of particles: steel shots 7.

Nominal diameter of steel shots 7: 0.3 mm.

Actual diameter of steel shots 7: from 0.1 to 0.4 mm.

Projection rate: from 3 to 30 kg/min/$m^2$.

Projection speed (speed of steel shots 7): from 12 to 52 meters/sec.

Diameter of impellers 10: 250 mm.

Linear-strain pitch (p): 10 mm

Width of slits 2: approximately 0.7 mm.

Transferring speed of steel sheet 1 (circumferential speed of rotatable drum 9): from 0.3 to 3.0 meters/-min.

$W_{17/50}$, which was measured by SST (measurement of a single sheet), and $B_8$ are given in FIG. 8. As is apparent from FIG. 7, when the projection speed was appropriately selected, $W_{17/50}$ was reduced as compared with $W_{17/50}$ before the projection of particles so that a very low watt loss was achieved. $B_8$ was slightly reduced at a projection speed at which a reduction in $W_{17/50}$ was achieved. Such a slight reduction in $B_8$ practically involves no problem.

We claim:

1. A method for reducing the watt loss of a grain-oriented electromagnetic steel sheet, characterized in that: after final annealing of a steel sheet during which grain orientation occurs an insulating film is applied to the surface of said grain-oriented electromagnetic steel sheet, and thereafter, particles consisting of metal are projected onto substantially linear selected portions of the surface of said grain-oriented electromagnetic steel sheet having said applied insulating film thereon to form spot-like indentations in said steel sheet in said linear selected portions, wherein said linear selected portions are parallel to one another and are oriented transverse to the longitudinal direction of the grain-oriented electromagnetic steel sheet, with said projecting taking place at a projection speed of from 12 to 52 m/sec and at a projection amount of from 3 to 30 kg/min/$m^2$ thereby producing strain in the spot-like indentations of said selected portions of said grain-oriented electromagnetic steel sheet, said spot-like indentations having a diameter of from approximately 60 to 80 microns and a depth of from approximately 3 to 5 microns, and said selected portions are spaced from one another at a distance of from 3 to 10 mm.

2. A method according to claim 1, wherein each of said substantially linear selected portions of the grain-oriented electromagnetic steel sheet is a continuous line or curve.

3. A method according to claim 1, wherein each of said substantially linear selected portions of the grain-oriented electromagnetic steel sheet is a discontinuous line or curve.

* * * * *